US007707666B2

(12) United States Patent
Calkin et al.

(10) Patent No.: US 7,707,666 B2
(45) Date of Patent: May 4, 2010

(54) LITTER TIE-DOWN APPARATUS

(75) Inventors: Carston R. Calkin, Tualatin, OR (US); Joseph J. Marak, Whitewater, CO (US)

(73) Assignee: Skedco, Inc., Tualatin, OR (US)

( * ) Notice: Subject to any disclaimer, the term of this patent is extended or adjusted under 35 U.S.C. 154(b) by 0 days.

(21) Appl. No.: 11/811,225

(22) Filed: Jun. 7, 2007

(65) Prior Publication Data

US 2008/0110002 A1 May 15, 2008

Related U.S. Application Data

(60) Provisional application No. 60/812,334, filed on Jun. 8, 2006.

(51) Int. Cl.
*A61G 7/10* (2006.01)

(52) U.S. Cl. ..... 5/626; 5/624; 5/81.1 R

(58) Field of Classification Search ..... 5/625, 5/628, 81.1 R, 118, 81.1 HS, 81.1, 624
See application file for complete search history.

(56) References Cited

U.S. PATENT DOCUMENTS 3,775,784 A * 12/1973 Fry ..... 5/81.1 C
5,317,770 A * 6/1994 Sakurai ..... 5/625

* cited by examiner

*Primary Examiner*—Fredrick Conley
(74) *Attorney, Agent, or Firm*—Stoel Rives LLP

(57) ABSTRACT

A litter tie-down apparatus is provided for quickly and easily securing a litter safely and securely in a transporting vehicle, the apparatus having a main body strap member arranged to engage the lift handles of a litter, the strap member mounting a pair of adjustable-length securement strap members arranged for connection to a securement fixture in a vehicle, and a ratchet winder assembly is provided to shorten at least one of the securement strap members and thereby tension the apparatus and litter against movement in the vehicle. A quick release arrangement selectively operates to immediately loosen the securement straps and allow the main body member to be slided off of the lift handles of the litter for emergency evacuation of the litter and patient from the vehicle.

14 Claims, 2 Drawing Sheets

LITTER TIE-DOWN APPARATUS

This application claims benefit under 35 U.S.C. 119(e) of the priority filing of U.S. Provisional application Ser. No. 60/812,334, Filed 8 Jun. 2006.

BACKGROUND OF THE INVENTION

This invention relates to litters used in the emergency transport of soldiers and other injured persons in field situations and more particularly to a litter tie-down apparatus to safely and effectively secure a patient-supporting litter in place in a vehicle to prevent from the litter from movement, rearward, laterally or vertically during operation of the vehicle in transporting the patient to a medical facility or other safe location.

Litters are well known patient transport devices particularly in field situations such as military battlefields and such, and typically comprise a pair of longitudinally elongated, laterally spaced apart poles which terminate in opposite end lifting handles, a sheet of flexible fabric material being secured in spanning condition between the pair of poles to form a bed-like surface upon which a patient is lain and strapped down. A pair of tending personnel, one disposed at each end of the litter, may then grasp the lifting handles and lift and carry the litter and reclined patient to a rescue aircraft or ground vehicle wherein the litter is secured in place prior to transport to a medical facility.

As will be appreciated by those skilled in the art, it is critical that the patient-supporting litter be positively secured in the vehicle against any free movement that may result during operation of the vehicle and cause the litter to slide about or worse, tip over, tumble or otherwise become displaced with potential further injury to the already-injured patient. As will be recognized, travel in a ground vehicle in battlefield terrain can be extremely rough and precarious and travel in an aircraft is also a rough and turbulent ride at times.

Accordingly it is a well known practice to tie or otherwise secure litters down in vehicles in order to secure them against undesirable movements due to the vehicle's motions. However, while the releasable securement of litters is clearly an important aspect in the vehicle transport of litter-born patients, it is also essential that the litter be able to be quickly released from its securement in the event of accident, fire or other need for emergency evacuation from the vehicle. To this end, military requirements and regulations provide that a litter, when secured in the vehicle, must be able to be freed of its tied down securement in the vehicle within 30 seconds time, to assure for timely emergency evacuation of the litter and its occupant in the event of urgent need, such as fire, explosion, crash or other occurrence requiring immediate emergency evacuation of the vehicle.

The present invention provides a litter tie-down apparatus that is specifically arranged to provide for quick and simplified positive securement of a litter in place in a vehicle, and also is arranged to permit quick release and disconnection from the litter whereby the litter is completely freed in very short order for facilitated emergency evacuation of the litter and its occupant from the vehicle.

SUMMARY OF THE INVENTION

In its basic concept, this invention provides a litter tie-down apparatus having a laterally elongated main body strap member arranged with opposite end loops for engaging the lift handles of a litter, the main strap member mounting a ratchet winder assembly which in turn mounts a pair of opposite securement strap members provided at their outer ends for connection to a pair of securement mount fixtures on the vehicle, the ratchet winder assembly operable to wind up at least one of the securement strap members to tighten the litter against its underlying support, the ratchet winder assembly including a quick release mechanism operable to quickly loosen the securement straps to permit the main body strap member to be quickly slid off the litter lift handles to quickly free the litter for evacuation from the vehicle.

It is by virtue of the foregoing basic concept that the principal objective of this invention is achieved; namely, the provision of a litter tie-down apparatus that facilitates both securement and urgent disconnection of a litter within a vehicle, thereby overcoming the disadvantages and limitations of litter securement devices provided heretofore.

Another object and advantage of the present invention is the provision of a litter tie-down apparatus of the class described which utilizes a fabric main body strap member and fabric securement strap members for permitting the tie-down apparatus to be collapsed into a small, storage condition for facilitated storage when not in use.

Another object and advantage of the present invention is the provision of a litter tie-down apparatus of the class described which requires no adjustment of the length of the main body strap member for engagement with the lifting handles of conventional litters.

Another object and advantage of the present invention is the provision of a litter tie-down apparatus of the class described which is arranged for alternative securement to a securement mount fixture in a vehicle by carabiner or other suitable fastener apparatus interengaging the securement strap members and available securement mount vehicles on a vehicle.

Yet another object and advantage of the present invention is the provision of a litter tie-down apparatus of the class described which is arranged to provide for release from litter-securing condition and separation from a litter in an amount of time well within the time limitations required by military regulation governing emergency evacuation requirements for litters from vehicles.

A further object and advantage of the present invention is the provision of a litter tie-down apparatus of the class described which is arranged to be released from a litter being supported simply by loosening the securement strap members and sliding the main body strap member off of the lifting handles of the litter without need of disconnection of the tie-down apparatus from the mount fixtures of the vehicle.

A further object and advantage of the present invention is the provision of a litter tie-down apparatus of the class described which is arranged to adjustably accommodate connection to available mounting fixtures in a vehicle disposed at different heights and positions relative to a litter being secured.

A still further object and advantage of the present invention is the provision of a litter tie-down apparatus of the class described which is arranged to provide simplified, non-complicated installation of the tie-down apparatus and simple, non complicated release and disconnection of the tie-down apparatus to reduce training requirements and facilitate easy, straightforward use and operation of the apparatus especially in emergency situations in which safety to both patient and tending personnel requires expediency.

A still further object and advantage of the present invention is the provision of a litter tie-down apparatus of the class described which is of simplified construction for economical manufacture and reliability in use.

The foregoing and other objects and advantages of the present invention will appear from the following detailed description, taken in connection with the accompanying drawings of a preferred embodiment.

DESCRIPTION OF THE PREFERRED EMBODIMENT

Figure 1:
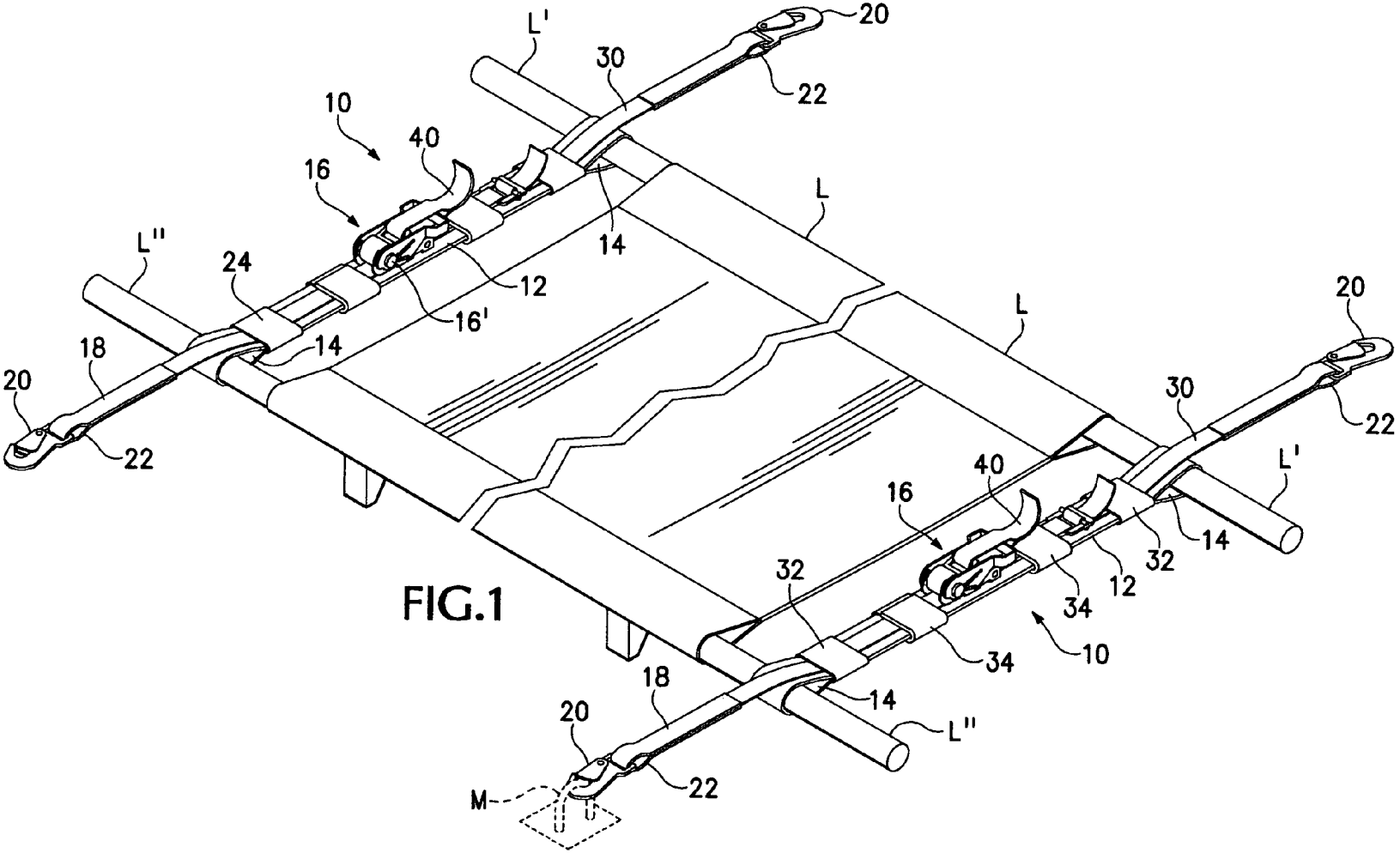
FIG. 1 is a foreshortened, top perspective view of a litter being secured in a vehicle by a pair of tie-down strap members embodying features of the present invention.
Figure 2:
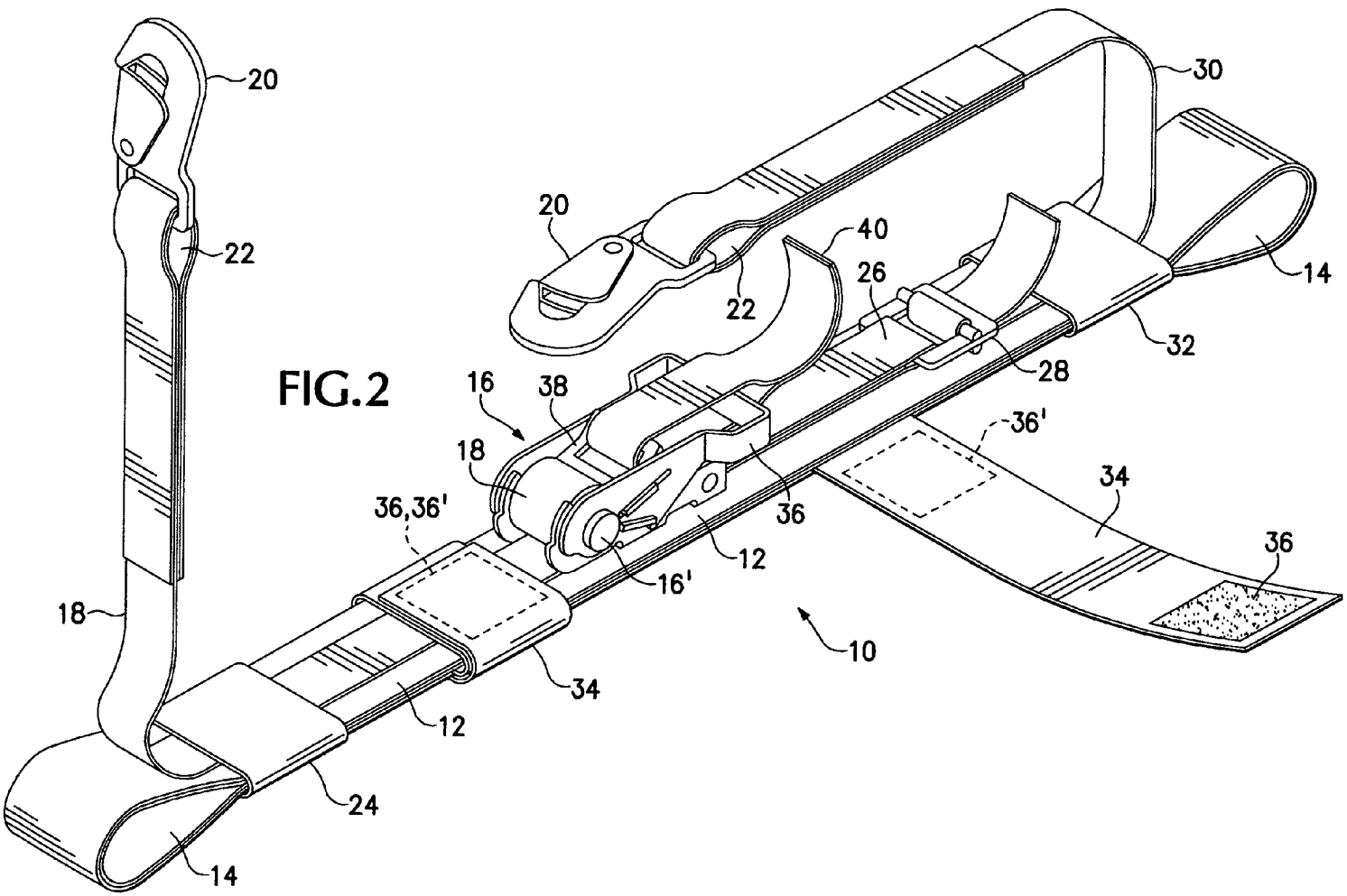
FIG. 2 is a top perspective view on an enlarged scale of the litter tie-down apparatus of FIG. 1 showing the construction in closer detail.

A litter tie-down apparatus embodying features of the present invention is illustrated in FIGS. 1 and 2 of the drawings. Although the apparatus is being shown in a preferred form herein, it is to be understood that the particular structural arrangements shown are illustrative of arrangements suitable for the purpose, and that other suitable arrangements may be provided as alternatives if so desired or needed for the particular purpose.

FIG. 1 is a foreshortened perspective view illustrating a typical litter L which as is well known, includes lifting handles L', L" projecting from each longitudinal end of the litter. FIG. 1 shows the litter tie-down apparatus 10 of this invention engaging the lifting handles at the opposite ends of a litter as will be explained.

As seen in FIGS. 1 and 2, the tie-down apparatus includes a main body strap member 12 arranged to mount or terminate in end loop members 14 arranged to receive therethrough the lifting handles L', L" as seen in FIG. 1 of the drawings. Although in its preferred form the strap member is formed of heavy duty, reinforced fabric material in which the end loops 14 are formed by overlapping and stitching of the material, the main body strap member 12 may if desired be alternatively formed of rigid material such as synthetic thermoplastic resin material formed with loops 14 as will be apparent.

As shown, the main body strap member 12 supports a ratchet assembly 16 engaging on its winder drum 16' a first securement strap member 18 having a preselected overall length sufficient to extend from the ratchet winder mechanism to a securement fixture M mounted in a vehicle (not shown) as will be apparent in FIG. 1. The outer, free terminal end of the first securement strap member 18 mounts a selected fastener member 20 such as snap hook 20 illustrated. The strap member 18 may if desired also include a loop 22 formed at the terminal end mounting the fastener member 20 in order to receive an alternate fastener member, such as a carabiner (not shown) for alternative connection of the strap end portion to a securement fixture on a vehicle if so needed or desired. The first securement strap member 18 is slidably retained against the main body strap member 12 as by a strap confinement loop 24 secured on the main body strap member 12 adjacent the loop member 14.

As seen best in FIG. 2, the base portion of the ratchet winding mechanism 16 fixedly mounts the end of a strap member 26 which in turn mounts at its opposite outer terminal end an adjustable buckle mount member 28 which in turn receives and adjustably secures an end portion of a second securement strap member 30 which is arranged to extend from the opposite end of the main body strap member. The strap member 30 is slidably retained against the main strap member by a strap confinement loop member 32 similar to the loop member 24 previously described. As seen best in FIG. 2, the outer terminal end of second securement strap member 30 also mounts a connector member 20 arranged for connection to a securement mount fixture M in a vehicle as described in connection with first securement strap member 18. Similarly, the outer end portion of the second securement strap member 30 may also include a loop member 22 for an alternate connector such as a carabiner if so desired.

Preferably means is provided to retain the ratchet winder assembly 16 in position disposed substantially centrally on the strap member 12 between the opposite loops 14 adjacent its longitudinal terminal ends. In the embodiment illustrated, confining loop members 34 are secured on the main body strap member 12, one on each side of the ratchet assembly 16 and arranged to freely overlie the corresponding straps 18, 26, whereby to prevent longitudinal movement of the ratchet assembly on the main body strap member 12 by abutment with one strap 34 or the other caused by tension or pulling movement on the respective securement straps 18, 30 as will be appreciated. These confining loop members 34 also prevent displacement of the ratchet mechanism 16 during ratcheting operation to wind the securement strap 18 onto the winding drum 16' as is known in these devices. As seen in FIG. 2, the confining loop members may if desired be provided as lengths of strap material secured to the base body strap member 12 and arranged to be wrapped over and around the straps and body member and be releasably secured in place as by corresponding first 36 and second 36' components of a conventional hook and loop type fastener arrangement.

Referring briefly again to the strap winding ratchet mechanism 16, the apparatus includes a ratchet-operating handle member 36 arranged to engage the winding drum through a ratchet assembly whereby operation of the ratchet handle member effects indexed rotation of the drum 16' in a direction to wind the strap 18 onto the drum. The ratchet arrangement, as is well understood in these devices, prevents undesired, reverse rotation of the drum member with consequent unwinding of the strap member. The ratchet strap winding mechanism also includes a release mechanism 38 which is operable, when pulled upon, to disengage the ratchet connection to allow free, reverse rotation of the winding drum when so desired. In the embodiment illustrated, the release member 38 of the ratchet is engaged by a release strap member 40 arranged with a loop section configured to engage the release member 38 and capture within its interior the handle member 36 as seen clearly in FIG. 2. By grasping the release strap member 40 and pulling upon it towards the right in FIG. 2, the release member 38 is pulled to disengage the ratchet system and free the drum member to permit unwinding of the strap 18 wound thereabout.

From the foregoing, reference is now primarily directed to FIG. 1 of the drawings wherein it will be understood that a litter L, which would in these circumstances have an injured person secured on it, is positioned in a designated position in a transport vehicle. The litter tie-down apparatus is installed onto the litter by passing the litter handles L', L" through the corresponding loops 14 at the ends of the main body strap member 12. The free end of the strap member 30 is then directed to a designated securement fixture M on a vehicle and engaged therewith by the connector member 20 or other securement fixture if provided through loop 22. The length of the strap member 30 is then adjusted to snug the strap by adjusting the length of the strap 30 through the strap adjustment buckle member 28 as is apparent in FIG. 2. It should be mentioned that once this length has been established for a given vehicle, this adjustment of the strap 30 will likely not have to be done again in subsequent operations when that vehicle is used.

The other securement strap member 18 is extended to a corresponding securement fixture M on the vehicle and connected thereto as by the end connector member 20 or carabiner type arrangement described hereinbefore. With the opposite terminal ends of the strap members 18, 30 thus secured to fixed mounts M on the vehicle, the handle of the ratchet member is grasped and operated to wind the opposite end length of the strap 18 onto the winder drum 16' until the assembly is tightened sufficiently to positively secure the end of the litter against movement. The opposite longitudinal end of the litter is then secured by a second litter tie-down apparatus 10 as will be apparent. The litter is thus tensionably secured positively and safely in designated position in the vehicle for operation of the vehicle to transport the injured person for medical attention at a facility.

As is well understood in the military, military requirements and regulations provide that litters, when secured in vehicles, must be freed from their tie-down support within 30 seconds for emergency evacuation of the litter and its occupant from a vehicle in the event of urgent need, such as a fire, explosion or other occurrence requiring the urgent evacuation of the vehicle. In this regard, to release the litter from its secured condition, a person need only grab the release strap member 40 and pull on it outwardly and then upwardly whereby to release the winder ratchet mechanism and simultaneously pull upwardly on the ratchet assembly, causing the winder drum to freely pay out the strap 18, thereby loosening the tension on the securement strap and main body. The main body member may be slid off of the lift handles L', L" without need of disconnecting the securement strap end fittings 20 from their mount. This release operation thus entails only a few seconds from a fully secured tie-down condition to a fully released condition completely separated from the litter structure. Accordingly, both ends of the litter may be released and the litter freed for removal in an exceedingly quick period of time in such an emergency.

From the foregoing it will be apparent to those skilled in the art that many changes other than those already described may be made in the size, shape, type, number and arrangement of parts described hereinbefore without departing from the spirit of this invention and the scope of the appended claims.

The invention claimed is:

1. A litter tie-down apparatus for releasably securing a litter in place in an air or ground vehicle during operation of the vehicle to transfer a patient on the litter to a medical facility for treatment, the liter including a body supporting member and lifting handles extending from the body supporting member, the liter tie-down apparatus comprising:

a) a longitudinally elongated main body strap member terminating in opposite longitudinal terminal ends, each end mounting a loop member arranged to transversely receive therethrough a lifting handle of the litter, b) first and second elongated, flexible securement strap members overlying said main body strap member having inner end portions secured on said main body strap member for extension of the opposite, outer, free end portions of the securement strap members outwardly beyond respective opposite loop members of the main body strap member, the outer free ends of each securement strap member mounting a selected fastener member arranged for releasable connection to a securement fixture mounted on a vehicle transporting the litter, c) adjustment means supported on the main body strap member for engaging the first securement strap member and for adjusting the length of the first securement strap member extending outwardly from one loop member of the main body strap member, and d) quick-release adjustment means supported on the main body strap member for engaging the second securement strap member and for adjusting the length of the second securement strap member extending outwardly from the other, opposite loop member of the main body strap member, and for quickly releasing the strap member from an adjusted length, e) whereby, with the main body strap member engaging the lifting handles of the litter and the securement strap fastener members connected to securement fixtures in a vehicle, the length of each securement strap member may be shortened into a tensioned condition of interengagement between the securement fixtures and the litter-engaging main body securement strap in which the litter is secured against movement on the vehicle, and the tensioned condition may be quickly released when desired to permit separation of the main body strap member from the lifting handles for removal of the litter from the vehicle.

2. The litter tie-down apparatus of claim 1 wherein said quick release adjustment means engaging said second securement strap member comprises a ratchet assembly arranged to engage the second securement strap member and operable to shorten the extending portion of the second securement strap member on operation of the ratchet assembly and to prevent unintended lengthening of the second securement strap member, said ratchet assembly including a ratchet release structure selectively operable to permit substantially unrestricted lengthening of the extending portion of the second securement strap member from the ratchet assembly.

3. The litter tie-down apparatus of claim 2 wherein said ratchet assembly operatively engages a strap-engaging winder drum to rotate the drum in one direction upon ratcheting operation of the ratchet assembly to wind the second securement strap onto the winder drum to shorten the length of the extending portion of the second securement strap member, said ratchet release structure operable to release operative engagement of the ratchet structure and winder drum to permit substantially unrestricted rotation of the winder drum in the opposite direction to pay out and lengthen the extended portion of the securement second strap member.

4. The litter tie-down apparatus of claim 2 wherein said ratchet assembly includes a base member engaging the inner terminal end portion of said first securement strap member, and said adjustment means engaging said first securement strap member comprises an adjustable buckle mount member arranged to releasably secure the strap member at selected lengths of extension from the buckle mount member.

5. The litter tie-down apparatus of claim 1 wherein said main body strap member and said first and second securement strap members are formed of selected flexible fabric webbing material.

6. The litter tie-down apparatus of claim 1 wherein said first and second securement strap members each include a loop member adjacent the outer, free terminal ends thereof for receiving and mounting at least one fastener member for connection to different securement fixture mounts available in a transport vehicle.

7. A litter tie-down apparatus for releasably securing a litter in place in an air or ground vehicle during operation of the vehicle to transfer a patient on the liter to a medical facility for treatment, the litter including a body supporting member and lifting handles extending from the body supporting member, the liter tie down apparatus comprising:

a securement strap tensioning device including a quick release and an adjustable mount, the adjustable mount configured to adjustably attach a securement strap to the securement strap tensioning device;

a first securement strap having a first end and a second end, the first end adjustably attached to the adjustable mount;

a second securement strap having a first end and a second end, the first end engaging the securement strap tensioning device;

a first fastener attached to the second end of the first securement strap;

a second fastener attached to the second end of the second securement strap; and a main body strap having a first end and a second end, the first end including a first litter handle engaging element for receiving one lifting handle transversely therethrough, the second end including a second litter handle engaging element for receiving another lifting handle transversely therethrough, the main body strap underlying and slidably supporting the first securement strap, the second securement strap, and the securement strap tensioning device.

8. A litter tie-down apparatus according to claim 7, further comprising:

a first confining member attached to the main body strap and located on the main body strap to limit sliding movement of the securement strap tensioning device in a first direction; and a second confining member attached to the main body strap and located on the main body strap to limit sliding movement of the securement strap tensioning device in a second direction, the second direction opposite the first direction.

9. A litter tie-down apparatus according to claim 8, wherein:

the first confining member is a loop overlying the first securement strap, and the first confining member is attached to the main body strap on a side opposite where the securement strap tensioning device is slidably supported on the main body strap; and the second confining member is a loop overlying the second securement strap, and the second confining member is attached to the main body strap on a side opposite where the securement strap tensioning device is slidably supported on the main body strap.

10. A litter tie-down apparatus according to claim 7, further comprising:

a first strap confining member attached to the main body strap, the first strap confining member located on the main body strap between the securement strap tensioning device and the first end of the main body strap, and the first strap confining member configured to slidably retain the first securement strap to the main body strap; and a second strap confining member attached to the main body strap, the second strap confining member located on the main body strap between the securement strap tensioning device and the second end of the main body strap, and the second strap confining member configured to slidably retain the second securement strap to the main body strap.

11. A litter tie-down apparatus according to claim 10, wherein:

the first strap confining member is a loop overlying the first securement strap, and the first strap confining member is attached to the main body strap on a side opposite where the first securement strap is slidably supported on the main body strap; and the second strap confining member is a loop overlying the second securement strap, and the second strap confining member is attached to the main body strap on a side opposite where the second securement strap is slidably supported on the main body strap.

12. A litter tie-down apparatus according to claim 7, further comprising:

a first supplemental attachment point located proximate the second end of the first securement strap; and a second supplemental attachment point located proximate the second end of the second securement strap.

13. A litter tie-down apparatus according to claim 12, wherein the first and second supplemental attachment points include loops.

14. A litter tie-down apparatus according to claim 7, wherein:

the securement strap tensioning device includes a ratchet assembly;

the adjustable mount member includes a buckle; and the first and second litter handle engaging elements include loop members.

* * * * *

UNITED STATES PATENT AND TRADEMARK OFFICE

CERTIFICATE OF CORRECTION

PATENT NO. : 7,707,666 B2
APPLICATION NO. : 11/811225
DATED : May 4, 2010
INVENTOR(S) : Carston R. Calkin and Joseph J. Marak It is certified that error appears in the above-identified patent and that said Letters Patent is hereby corrected as shown below:

In column 5, line 46, replace "liter" with --litter--.

In column 5, line 48, replace "liter" with --litter--.

In column 5, line 54, delete the words "overlying said main body strap member".

In column 5, line 58, replace "beyond" with --from--.

In column 5, line 58, replace "loop members" with --terminal ends--.

In column 5, line 59, replace "free" with --terminal--.

In column 5, line 66, replace "loop member" with --terminal end--.

In column 6, line 5, replace "loop member" with --terminal end--.

In column 6, line 62, replace "liter" with --litter--.

In column 6, line 65, replace "liter tie down" with --litter tie-down--.

In column 7, line 17 carrying over to line 18, delete the words "underlying and".

Signed and Sealed this

Eighth Day of June, 2010

David J. Kappos

David J. Kappos
*Director of the United States Patent and Trademark Office*